United States Patent [19]

Fung

[11] 4,384,611

[45] May 24, 1983

[54] HEAT EXCHANGER

[75] Inventor: James Y. Fung, Closter, N.J.

[73] Assignee: HXK Inc., Bogota, N.J.

[21] Appl. No.: 201,600

[22] Filed: Oct. 28, 1980

Related U.S. Application Data

[63] Continuation of Ser. No. 905,789, May 15, 1978, abandoned.

[51] Int. Cl.[3] ..... F28F 3/00; F28F 3/08

[52] U.S. Cl. ..... 165/166

[58] Field of Search ..... 165/157, 166, 167

[56] References Cited

U.S. PATENT DOCUMENTS

| | | | |
|---|---|---|---|
| 1,548,159 | 8/1925 | Murray | 165/166 |
| 1,966,133 | 7/1934 | Pieper | 165/166 |
| 2,321,110 | 6/1943 | Shipman | 165/166 |
| 2,361,691 | 10/1944 | Jendrassik | 165/166 |
| 2,462,421 | 2/1949 | Pitt | 165/166 |
| 2,877,000 | 3/1959 | Person | 165/166 |
| 2,945,680 | 7/1960 | Slemmons | 165/166 |
| 3,451,474 | 6/1969 | Cox | 165/166 |
| 3,545,062 | 12/1970 | Cox | 165/166 |
| 3,552,488 | 1/1971 | Grill | 165/166 |
| 3,827,343 | 8/1974 | Darm | 165/166 |
| 3,912,004 | 10/1975 | Darm | 165/166 |
| 4,116,271 | 9/1978 | Lepeleire | 165/166 |

*Primary Examiner*—William R. Cline
*Assistant Examiner*—Theophil W. Streule, Jr.
*Attorney, Agent, or Firm*—S. C. Yuter

[57] ABSTRACT

A heat exchanger core is formed from a single foil strip folded into successive U-bends to define alternate fluid passages, with even-numbered passages being for hot fluid and odd-numbered passages being for cold fluid. The folded foil thus defines three walls of each passage with the remaining fourth side open. Top and bottom plates cover and close the open sides of all the hot and cold passages respectively. The ends of certain passages remain open; the ends of other passages are selectively closed by pinching together the ends of adjacent foil walls which define the passages. A pre-formed end plate has apertures between deformable ribs; the apertures are aligned with the ends of open passages, and the ribs overlie and are joined with the pinched ends of the closed passages.

13 Claims, 37 Drawing Figures

FIG. 5A
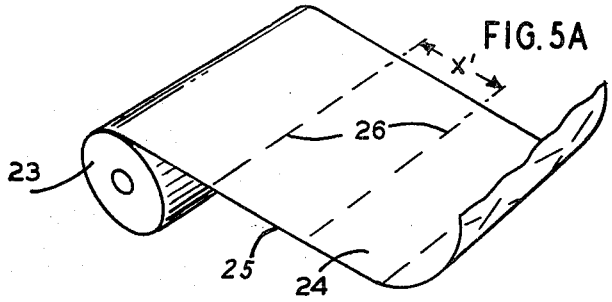
FIG. 5B
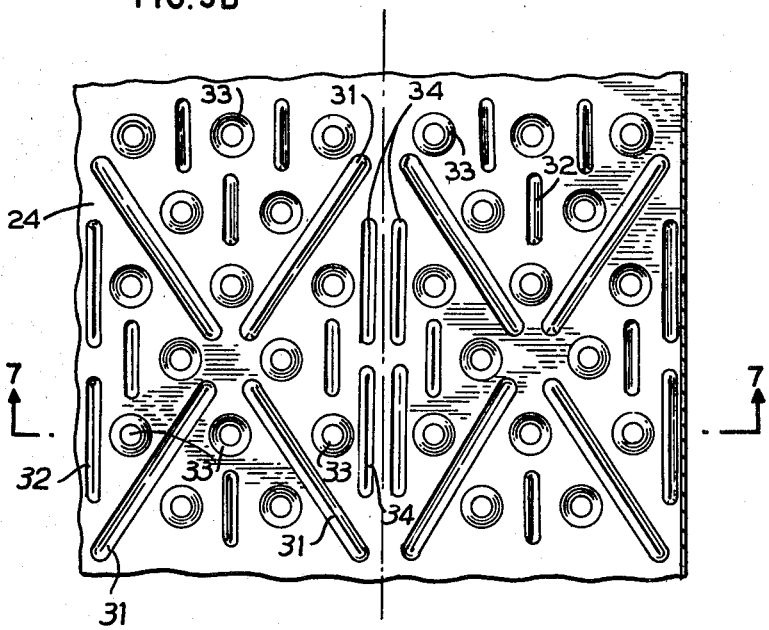
FIG. 7
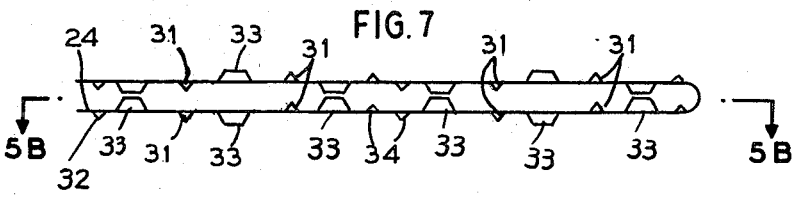
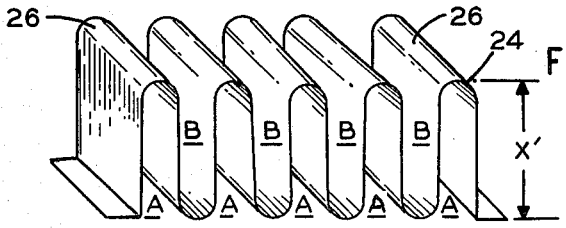
FIG. 6

FIG. 10
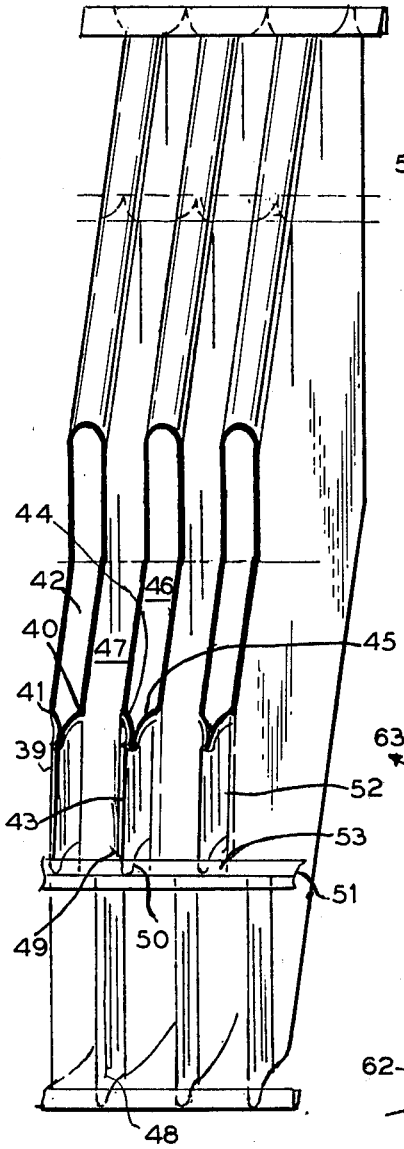
FIG. 11
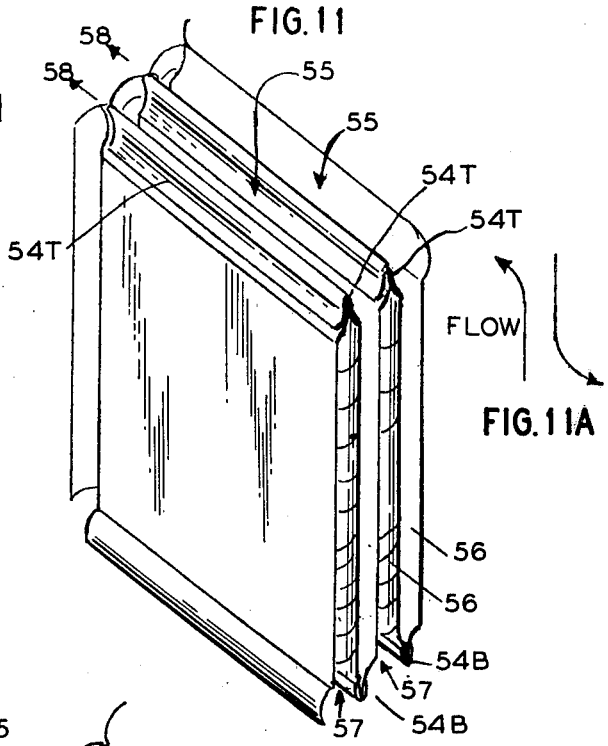
FIG. 11A
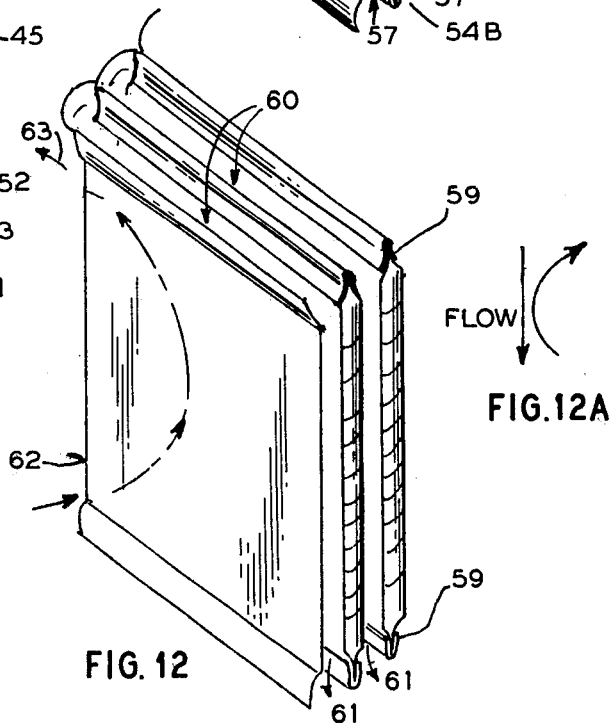
FIG. 12A
FIG. 12

SECTION A-A

FIG.16
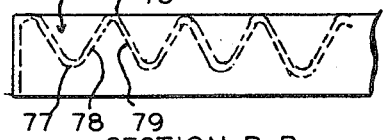
SECTION B-B
FIG.17
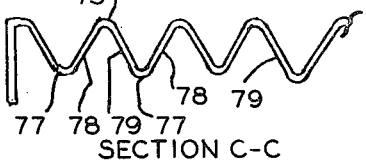
SECTION C-C
FIG.18
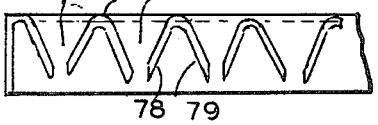
FIG.19
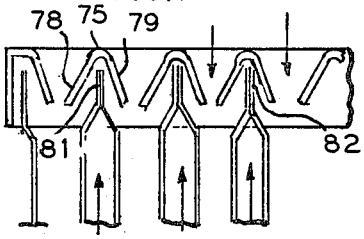
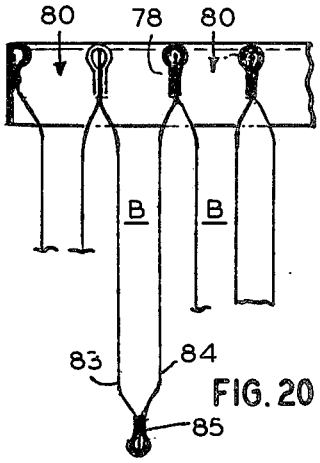
FIG.20
FIG.21
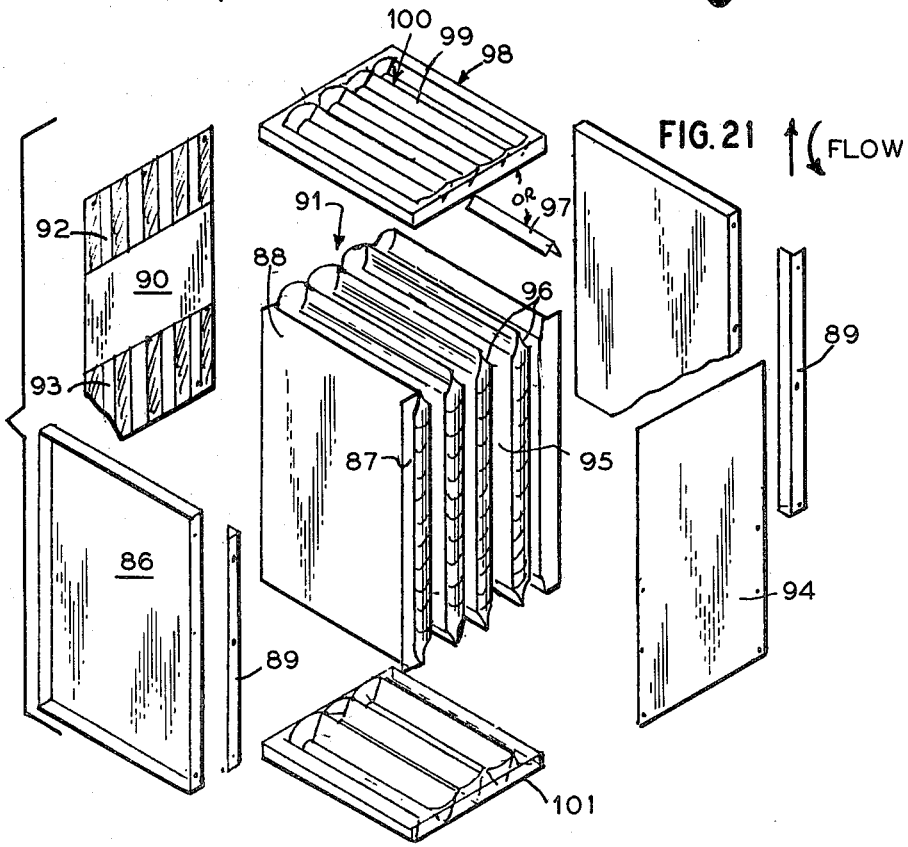

FIG. 27

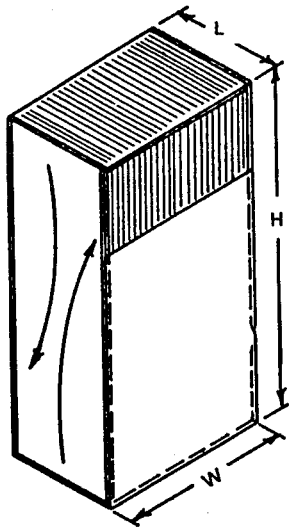

SERIES H

| Model No. | H x W x L | CFM Range | 1,000 Ft./Min. Eff. | P.D. | Wt. |
|---|---|---|---|---|---|
| H-1 | 48½x24x16¼ | 700 to 1500 | 67.5 | .8 | 84 |
| H-2 | 36½x24x16¼ | 700 to 1500 | 61 | .7 | 70 |
| H-3 | 48½x24x8¼ | 350 to 750 | 67.5 | .8 | 45 |
| H-4 | 36½x24x8¼ | 350 to 750 | 61 | .7 | 35 |

Construction: 16 ga. aluminum casing
.008 thick heat transfer media

FIG. 26

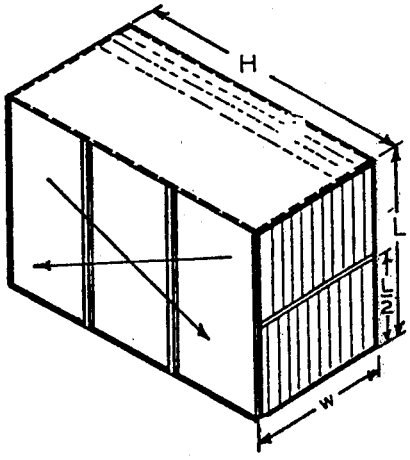

SERIES X

| Model No. | L x W x H | CFM Range | 1,000 Ft/Min. Eff. | P.D. | Wt. |
|---|---|---|---|---|---|
| X-1 | 48½x24x48⅜ | 2000 to 4000 | 67.5 | .8 | 325 |
| X-2 | 48½x24x36⅜ | 2000 to 4000 | 61 | .7 | 250 |
| X-3 | 32½x24x48⅜ | 500 to 3000 | 67.5 | .8 | 225 |
| X-4 | 32½x24x36⅜ | 1500 to 3000 | 61 | .7 | 175 |

Construction: 16 ga. aluminum casing
.008 thick heat transfer media

FIG. 28

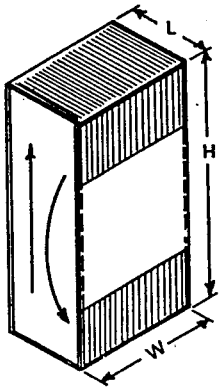

SERIES K

| Model No. | H x W x L | CFM Range | 1000Ft/Min. Eff. | P.D. | Wt. |
|---|---|---|---|---|---|
| K-1 | 48½x24x16¼ | 700 to 1500 | 67.5 | .8 | 84 |
| K-2 | 36½x24x16¼ | 700 to 1500 | 61 | .7 | 70 |
| K-3 | 48½x24x8¼ | 350 to 750 | 67.5 | .8 | 45 |
| K-4 | 36½x24x8¼ | 350 to 750 | 61 | .7 | 35 |

Construction: 16 ga. aluminum casing
.008 thick heat transfer media

FIG.29

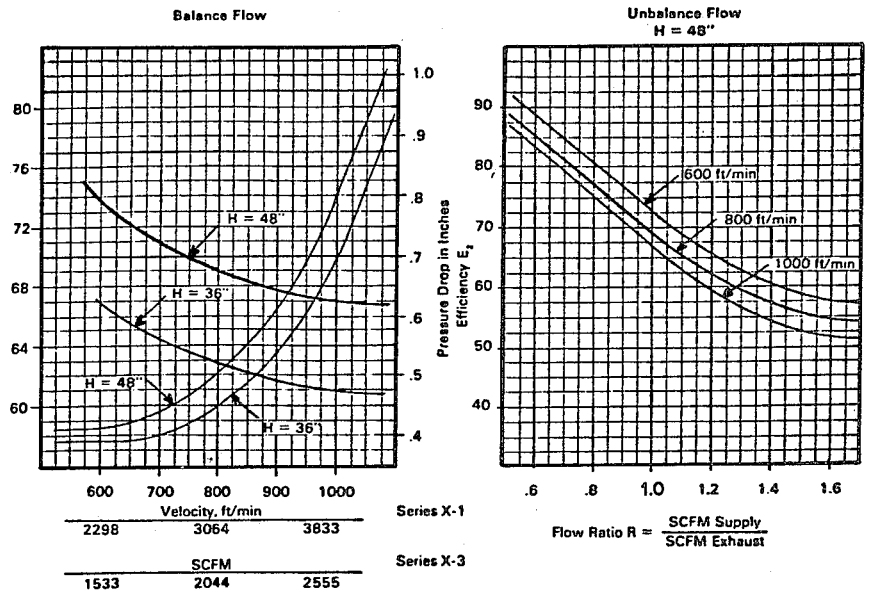

Formula to Convert Velocity to CFM

| | |
|---|---|
| Series H & K | CFM = velocity x 1.27 |
| Series X-1 & 2 | CFM = velocity x 3.83 |
| X-3 & 4 | CFM = velocity x 2.55 |

Example: Given 30,000 CFM, 8" W.C. from pressure drop velocity curve @ 1000 ft/min pressure drop .8"
X-1 = 3833 CFM/module at 1000 ft/min $$\frac{30{,}000}{3833} = 7.8 \text{ modules. use 8 modules}$$

Engineering Formula for Heat Recovery Calculation

$$SCFM = ACFM \frac{460 + 70}{460 + T}$$

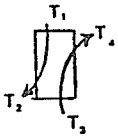

$T_2 = T_1 + E_2(T_2 - T_1)$ — use $E_1$ for balance flow system $T_4 = T_3 - E_2(T_3 - T_1)(R)$ $$R = \frac{\text{SCFM Supply}}{\text{SCFM Exhaust}}$$

$$P.D. = \frac{\text{STD Pressure Drop}}{C}$$ — "C" see chart below at given temperature and altitude

Altitude in Feet Above Sea Level

| Average Air Temperature °F | 0 | 1000 | 2000 | 3000 | 4000 | 5000 | 6000 |
|---|---|---|---|---|---|---|---|
| | Barometric Pressure in Inches | | | | | | |
| | 29.92 | 28.86 | 22.82 | 26.81 | 25.84 | 24.89 | 23.91 |
| 70 | 1.00 | .964 | .930 | .896 | .864 | .832 | .801 |
| 100 | .946 | .912 | .880 | .848 | .818 | .787 | .758 |
| 150 | .869 | .838 | .808 | .770 | .751 | .723 | .696 |
| 200 | .803 | .774 | .747 | .720 | .694 | .668 | .643 |
| 250 | .747 | .720 | .694 | .669 | .645 | .622 | .593 |
| 300 | .697 | .672 | .648 | .624 | .604 | .580 | .551 |
| 350 | .554 | .631 | .608 | .586 | .565 | .544 | .524 |

HEAT EXCHANGER

This is a continuation of application Ser. No. 905,789, filed May 15, 1978 now abandoned.

BACKGROUND OF THE INVENTION

This invention is in the field of heat exchangers and more particularly heat exchangers for transmitting thermal energy from one moving fluid to another with specific application for gaseous fluid mediums. Typically heat exchangers comprise a plurality of adjacent passageways with relatively hot and relatively cold fluids in adjacent passages for facilitating the transfer of thermal energy from the hot fluid through the passage walls to the cold fluid. It is common for the hot and cold fluids to flow in opposite directions or in perpendicular directions designated counter-flow and cross-flow respectively; also in some cases the fluids flow in the same direction designated parallel-flow.

In the various apparatus there are a variety of design parameters which are selected in particular combinations to achieve various objectives, while necessarily sacrificing other factors, and in effect trading off one advantage for a different disadvantage. Certain of the most relevant parameters are thermal efficiency, pressure drop of the fluid through the passageway, manufacturing cost, rate of fluid flow through the device, and size and weight of the heat exchanger. Additional features that are relatively well known in the heat exchanger art include the use of a plurality of separate plates or sheets to define and separate the fluid passages, and sealing means for joining the various edges of these partitions to the housing and preventing leakage of the fluid between chambers or from the overall apparatus. A still further feature of heat exchangers is the requirement of some type of manifold inlet or outlet whereby hot fluids may be directed to specific passages, while cold fluids are directed to the various alternate passages in between the hot passages.

Assembly techniques for typical heat exchangers include welding, brazing, bonding, crimping, and the use of fasteners. In substantially all situations there is the complication of holding together in precise spaced relationship a great many individual pieces so that the multitude of passageways can be defined in a structure which is otherwise semi-rigid as a whole, and wherein there is sufficient strength internally to prevent the passageways or walls forming said passages from buckling or warping due to the heat extremes experienced on the opposite sides of partition walls and throughout the apparatus.

SUMMARY OF THE INVENTION

This invention is a new heat exchanger preferably for counter-flow heat exchange of gaseous fluid mediums. The fluid flow passages are established by a new heat exchanger core which is a construction formed by a continuous foil strip formed into successive U-bends, thereby providing a plurality of foil partitions which define adjacent flow passages. When the resulting structure is oriented with these partition walls extending generally vertically, each passage will be defined by two adjacent, generally vertical walls, one generally horizontal wall, and one open side; therefore a first set of spaced-apart passages will have their open sides facing upward, and a second series of interspersed passages will have their open sides facing downward. A top plate will extend across and cover the open upward sides of the first set of passages, and a similar bottom plate will cover and close the second set of downward facing passages.

In preferred embodiments supplemental side walls are added to improve stability and to provide means for mounting the heat exchanger to associated structures. Finally there is the new end cap structure for cooperation with the open ends of the various passageways. In order to define specific flow paths of the fluid through the passages, it is necessary to block off portions of the ends of each passage, to thereby direct the fluid flow to and through the unblocked portions. For example, if there are not blocked portions of the ends of the passageways, and the heat exchanger is designed for counterflow operation, then hot fluid and cold fluid will flow in opposite directions and will essentially fill the passageways and will enter and exit essentially through the entire open portions of the various ends of these passages. By selectively and partially blocking the ends of these passages, a great variety of fluid flow paths within the general concept of counter-flow may be established.

The present invention uses three principal variations of the basic counter-flow flow pattern, which are designated Series X, Series H, and Series K and combinations thereof. In Series X for example, if the apparatus is oriented such that the passages extend horizontally and the hot fluid flows from left to right, such hot fluid in a Series X device enters at the upper portion at the left and flows generally downward to the bottom portion at the right; meanwhile the cold fluid enters at the upper portion at the right and flows generally downward to the lower portion at the left. This produces an X-shaped flow path between the hot and cold fluids which results in excellent thermal efficiency and provides a very convenient manner for separating the hot and cold fluids as will be explained below.

If there were no blockages and the hot and cold fluid flows at one end for example were all at the same horizontal and adjacent level, there could be a considerable problem in separating each hot flow from all the adjacent cold flows, and combining all the hot flows without intermixing them with any cold flows. However, in the Series X design, all the hot flows enter at the upper portion of one end, while all the cold flows are discharged from the lower portion of the same end. At the upper left portion where the hot flows enter into alternate passageways, the spaces between these passageways are blocked so that there is no interference from or with the cold fluid. Correspondingly, on the right side where hot flow passages are open for discharge, the spaces between these passages are blocked so that there is not interference with or from the entering cold flow. The ends of these passages are defined by the U-shaped edges of the foil. To block a flow path, the adjacent edges defining the path are pinched and sealed together in certain preferred embodiments of this invention. To facilitate this blocking there is an end cap, which in one embodiment is initially a flat sheet with apertures corresponding to the selected passageways; between each two apertures, there is provided a thin rib which is concave or V-shaped in the direction of the pinched portions of the end edges of the partitions. In assembly of a heat exchange core according to this invention, the concave face of each rib is placed adjacent to the pinched end of a foil passage, and the rib and pinched end are crimped or pinched together which serves dual purposes. First, this closes and seals selected ends of fluid passages; second, the one piece end plate contacts and is secured to all the partitions, and thus integrates and strengthens the assembly. With this kind of structure a single end cap component can cover the entire end of a heat exchange core, and simultaneously when assembled, seal all the blocked passages while cooperating in the definition of all the open passages.

In the manufacture of this new heat exchanger core an initial step is die-forming the surface of the foil strip to have a plurality of parallel bend lines perpendicular to the length of the strip and spaced apart to define the partitions. The die-forming also establishes a pattern in the foil surface of diagonal and axial stiffening ribs and generally circular spacer dimples, all of which constitute projections from the upper or lower surface of the foil. Each partition has essentially the same pattern, except that in each two adjacent partitions corresponding spacer dimples extend in the same direction and corresponding stiffening ribs extend in opposite directions. When the foil strip with these patterns is folded to define adjacent partitions, corresponding spacers will extend toward each other for spacing the partitions apart, and corresponding stiffening ribs will extend in the same direction so that the distance between these rib surfaces remains essentially the same as the distance between the flat portions of the partitions.

With the heat exchanger as described there is essentially no requirement for any sealing material such as resin or cement or welding or brazing to prevent leakage of the heat exchange fluids from the heat exchanger to the outside, or between hot and cold gas passages. This reduces both cost of manufacture and weight of the finished product. As indicated the rib structure of the end plate and assembly of this plate with the partitions provides sufficient rigidity for this heat exchanger to withstand extreme temperature and pressure differentials that develop. The die-formed, essentially one-piece continuously bent core also is very economical and relatively easy to make, and permits an automated operation which can be very accurate and permit very fast and high volume production.

Another important advantage of the invention is the fact that by simple removal of front and rear covers, substantially the entire interior of the passageways are exposed for inspection and cleaning. The stiffening ribs and spacer projections will partially interfere with a clear view to every square inch of the interior surfaces, however the exposure that is provided is sufficient for a thorough cleaning and for certain repairs if necessary.

It is also possible for the front and/or rear cover plates to be provided by a surface of another similar apparatus to which the new heat exchanger is attached. The result with a common wall would be equally strong and efficient, while rendering the basic apparatus substantially simpler and cheaper to construct.

A further benefit of the structure of the new invention is that fluid entering the device, flowing through and discharging from the device will have a very small pressure drop, because all the in-flow apertures at one end are aligned and spaced apart, and a manifold can direct fluid linearly through the manifold and into the inlet apertures, and thence through the device with minimal turning of the fluid or associated friction losses.

Although various metals or combinations of metals can be used, corrosion will be minimized or prevented where constructions are totally aluminum or totally stainless steel. As described earlier there will no cross-contamination and essentially no leakage between counter-flow passages, and the resulting design will be compact and light weight and may in fact be modular so that individual units can be easily stacked or aligned to create units of varying sizes. Furthermore the dimensions of any particular heat exchanger can be easily varied by simply beginning with a longer sheet of foil and creating in this sheet additional folds and partitions with correspondingly larger front plates and end plates. In operation such a sheet is continuously formed and folded which greatly reduces fabrication costs.

The end plates may be die-formed in an essentially one-step and very efficient process; however, it is also possible to construct end plates by using a welded or brazed frame and individually welded or brazed ribs. This latter version is more costly as regards manufacture of each specific end plate, however it eliminates the high initial expense for a suitable die. Also by using the die-formed end pieces the welding steps are eliminated, which not only reduces labor cost, but eliminates the heat which tends to warp and otherwise deform the product. Finally the all metal construction eliminates problems of toxicity that otherwise occurs when using epoxy, resins, or other sealants, as is generally necessary in the prior art.

The heat exchange devices of this invention may be used with air or a variety of different fluids and for many different purposes; it has been determined that these devices are particularly useful in powered ventilation systems where exhaust air heat recovery is of importance. The invention disclosure herein includes the basic structure and method of making new heat exchangers; however, further details such as welding, cutting, sealing, riveting, crimping, etc. can be found in standard practice and prior art literature.

BRIEF DESCRIPTION OF THE DRAWINGS

FIG. 5A is a perspective view of a foil strip;

FIG. 5B is a plan view of a portion of one panel of the foil after being die-formed;

FIG. 6 is a strip of foil from FIG. 5A, folded into successive U-bends for defining fluid passageways in the core portion of the heat exchanger;

FIG. 7 is a fragmentary end view of the folded sheet material of FIG. 6, showing spacer elements between adjacent partition walls;

FIG. 10 is a partial perspective view corresponding to FIGS. 6 and 9, showing further detail of the structure, wherein alternate upper and lower end edges are pinched to seal off selected passageways in the core portion of the heat exchanger;

FIG. 11 is a fragmentary perspective view corresponding generally to FIG. 9, but illustrating a Series-H heat exchanger of FIG. 2;

FIG. 11A shows schematically the flow path through the heat exchanger of FIG. 11;

FIG. 12 is a fragmentary perspective view corresponding generally to FIG. 9, but illustrating the Series-K heat exchanger of FIG. 3;

FIG. 12A shows schematically the flow path through the heat exchanger of FIG. 12;

FIG. 16 is a fragmentary elevation view, taken along line B—B of FIG. 15;

FIG. 17 is a fragmentary elevation in section taken along line C—C of FIG. 15;

FIG. 18 and FIG. 18A is a fragmentary elevation similar to FIG. 17, illustrating the next step of construction, wherein the lower portions of the grooves are pierced;

FIG. 19 is a fragmentary view illustrating an initial step of assembly of the end cap of FIG. 18 with pinched ends of the heat exchanger core, wherein each pinched end is inserted within a U-shaped groove portion;

FIG. 20 is similar to FIG. 19 illustrating the next step of assembly, wherein the U-shaped walls are crimped about the pinched portions of the core, thereby sealing same and simultaneously providing passageways between the core walls;

FIG. 21 is an exploded perspective view showing an assembly of the new Series-K heat exchanger, with frames for strengthening the side walls thereof;

FIGS. 26, 27, and 28 are charts showing dimensional and operational data respectively for Series-X, Series-H, and Series-K heat exchangers of various sizes made according to this invention.

FIG. 29 is a sheet of additional operational data for Series-X, H, and K heat exchangers according to the present invention.

DETAILED DESCRIPTION OF THE PREFERRED EMBODIMENTS

Figure 1:
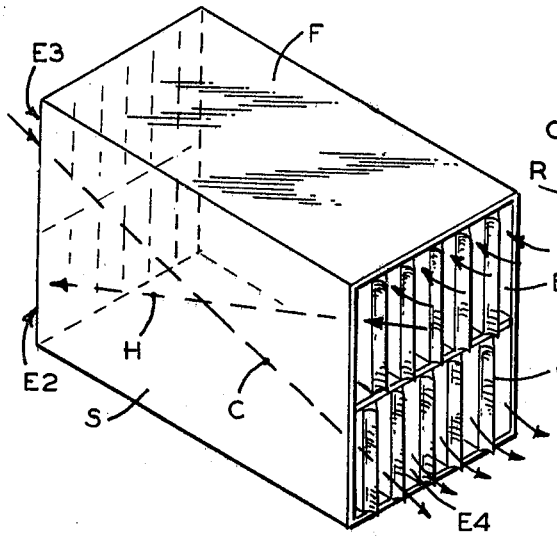
FIG. 1 is a perspective and schematic view of a Series-X heat exchanger of this invention.
Figure 2:
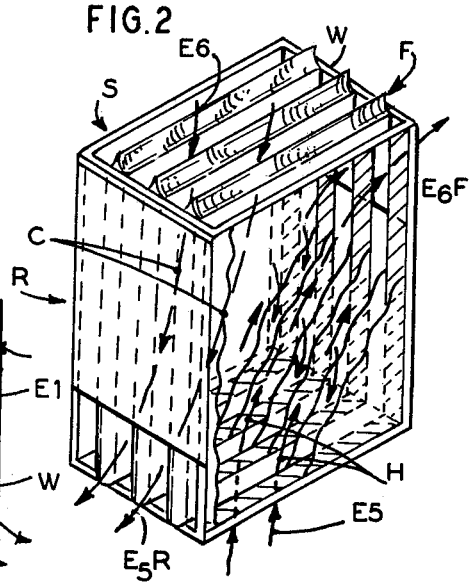
FIG. 2 is a perspective and schematic view of a Series-H heat exchanger thereof.
Figure 3:
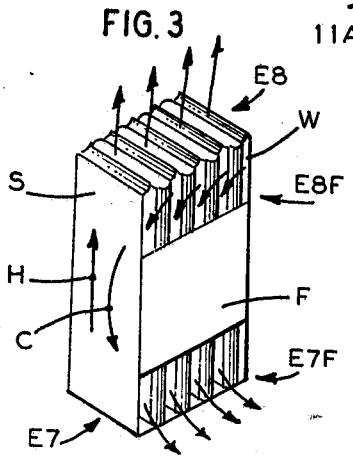
FIG. 3 is a perspective and schematic view of a Series-K heat exchanger thereof.

The new invention is a heat exchanger which may take a variety of forms. Three preferred emodiments in FIGS. 1–3 will be described in detail below as regards their structural features, operation, and resulting advantages. FIGS. 1A, 2A, and 3A are provided to help clarify the internal fluid flow paths in FIGS. 1, 2, and 3 respectively, and the reference numerals for the same components in corresponding figures are the same; reference to FIG. 1 for example, is intended to include FIG. 1A. In each of these embodiments there is a central core portion of the heat exchanger which is formed by a single continuous strip of metal or foil folded in accordian style to provide a plurality of relatively narrow and adjacent passageways for the various heat transfer mediums. These heat exchangers are essentially rectangular, having side walls S essentially parallel to the internal partition walls W which define the flow passages, top or front walls F, opposite bottom or rear walls, and opposite ends through which the fluid passageways discharge or receive the gaseous or other fluid medium. The shaded areas between adjacent partitions W indicate the portions of the ends or front sides of the passages that are closed, while the clear spaces between partitions indicate inlet and discharge apertures of these passages.

There are three principal embodiments illustrated, namely Series X, H and K heat exchangers. In all these embodiments the basic fluid flow pattern is counterflow with arrows H, C in FIGS. 1–3 indicating the general directions of hot and cold flows respectively. FIG. 1 represents the Series X heat exchanger, wherein the flow follows an X-shaped pattern; hot fluid enters the upper right end $E_1$ and exits from the lower left end $E_2$, while cold fluid enters the upper left end $E_3$ and exits the lower right end $E_4$. FIG. 2 represents the Series H heat exchanger wherein the hot flow enters one end $E_5$, traverses the length of the passage, and exits an end portion of the front surface $E_6F$ while cold flow enters the opposite end $E_6$, traverses the length of the flow passages, and exits an end portion of the rear surface $E_5R$.

FIG. 3 represents the Series K embodiment, wherein the hot flow for example enters one end $E_7$, traverses the length of the passages and exits the opposite end $E_8$, while the cold flow enters an end portion of the front surface $E_8F$ near the discharge end $E_8$ of the hot fluid, flows through the passage and exits through an end portion of the front surface $E_7F$ adjacent the end $E_7$ of the device where the hot fluid enters.

Figure 4:
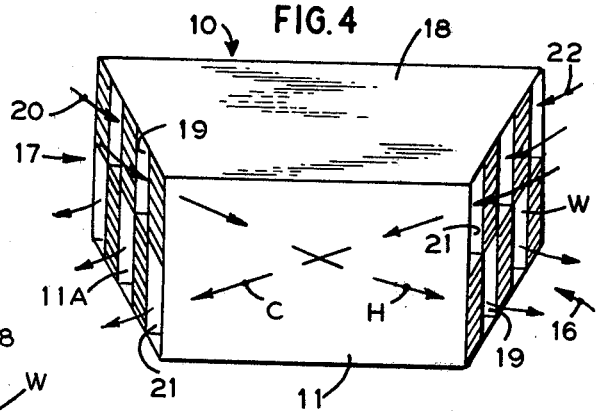
FIG. 4 is an expanded and intentionally distorted perspective view of the Series-X heat exchanger of FIG. 1 showing both ends of the apparatus simultaneously.

FIG. 4 is an intentionally distorted view of the heat exchanger like that of FIG. 1, and presented in this manner to illustrate more clearly the flow pattern in the Series X embodiment. Accordingly, heat exchanger 10 has a side wall 11 and a right end 16 and a left end 17, and a top (or front) surface 18 and a bottom (or rear) surface.

Now consider the first wall portion 19 visible at both ends 16 and 17; this wall portion 19 and outer wall 11 define the first passageway through which fluid flows from left to right as indicated by arrow 20. More particularly the fluid enters via the upper portion at the left end 17, and travels generally diagonally downward to the lower portion of the right end 16. Now consider the second wall partition 21 illustrated at both ends of the heat exchanger. Walls 21 and 19 define the second flow passage adjacent to the first, and as evidenced by arrow 22, the cold fluid enters at the upper right portion of this passage at the right end 16 and travels diagonally downward to the lower left of this passage exiting as shown at end 17. Consequently the flow patterns through the adjacent passages as indicated by arrows H and C define an X-shaped pattern.

FIG. 4 further illustrates how the end surfaces of the upper and lower portions are alternately blocked to define the passages as described. Thus all the hot fluid enters the upper left side through alternte inlet apertures and discharges at the lower right end through the alternate exit apertures; and all the cold fluid enters via the upper right end and discharges via the lower left end. In this manner it is relatively easy, for example, at left end 17, to separate the hot flow into the upper apertures from the cold flow in the lower apertures, and to conveniently manifold these flows in connection with inlet and outlet ducts.

Another advantage of this arrangement is that the overall pressure drop of the fluid through the device is maintained at a minimum, because the fluid is not required to turn around curves in order to be divided into separate inlet and outlet flows for the various passageways. More particularly, the fluid could flow continuously in one direction from a single source, then be divided into separate chambers in the same direction which communicate directly with the alternate openings at one end of the apparatus; the fluid could continue generally in a straight line through the device and exit at the opposite end and be recombined into a single outlet in a similar manner.

Construction of the new heat exchangers typically begins as illustrated in FIG. 5A with a roll 23 of deformable foil 24 in the form of a long strip that may have widths of 24", 36" or 48". The exposed end 25 of the foil is die-formed to define in its surface fold lines 26 and a pattern 27 of projections and depressions in the form of ribs and buttons. The foil may be aluminum, stainless steel or other suitable heat exchange material; the example shown is aluminum having thickness in the range of 0.003" to 0.080", and in this case 0.008".

The general approach to construction is to form consecutive U-bends in the strip as shown in FIG. 6, along the bend lines shown in FIG. 5A. The bends in this continuous strip form a first set of alternate passages A open on the downward side, and a second set of alternate passages B open on the upward side; the dimension X' of each panel or partition wall in FIG. 6 corresponds to the dimension X' in FIG. 5A between adjacent fold lines.

The pattern 27 of ribs and buttons formed on the foil strip in FIG. 5A, is shown in detail in FIG. 5B. There are diagonal ribs 31, axial ribs 32 and 34 and buttons 33. The various ribs are to stiffen the foil walls to resist bending and warping in all directions; the buttons are to function as spacers to prevent adjacent walls from converging and constricting the fluid flow therebetween. FIG. 7 illustrates how the button pattern of one panel is the mirror image of the adjacent panel, so that buttons 33 become aligned, contact each other, and serve to space the walls apart and add structural rigidity to the assembly.

When a sheet or foil is folded as indicated in FIGS. 6 and 7, for example, the spacing between any two partitions is approximately ¼ of an inch, and accordingly a typical button would extend approximately ⅛ of an inch, so that a pair of mating buttons would meet in the middle of a space between two partitions and equal the total space of one quarter inch. In one example of a strip having 92 folds, and each panel having a length of 48 inches and a width of 32 inches, the strip would have to be 245 feet long and would provide an area of 981 square feet. In contrast, with 92 panels 36 inches long and 8 inches wide, the strip would be 63 feet long, providing an area of 188 sq. feet. As discussed earlier in FIG. 4 for example, alternate passageways as indicated by A in FIG. 6 would contain the relatively hot fluid, while the interspersed passages indicated by B in FIG. 6 would contain the cold fluid. Subsequent figures illustrate how passageways A and B are sealed at the top and bottom and blocked in part at opposite ends.

Figure 8:
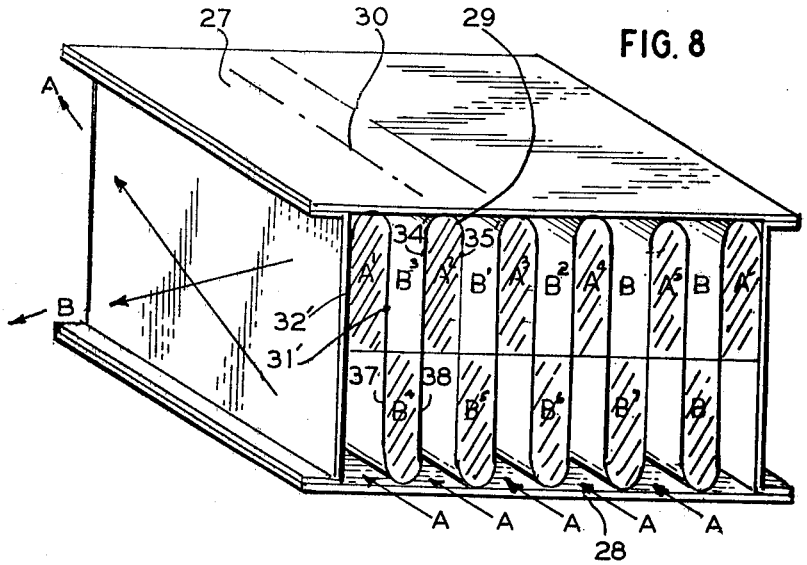
FIG. 8 in a schematic representation, shows a stage of assembly of a Series-X heat exchanger with top and bottom walls placed to close the open sides of the passages.

FIG. 8 shows the next step of construction of the heat exchanger after the sheet 24 is formed into the accordian folds of FIG. 6, with fluid passages A, $A_1$ $A_2$, B, $B_1$, $B_2$ etc. identified. Top and bottom plates 27 and 28 are positioned to close the exposed sides of alternate passages formed by the folded sheet. It might be noted that the top portion 29 of one particular fold engages a corresponding portion 30 indicated in dotted line along the top wall 27. Should there be leakage between passages $B_1$ and $B_2$ in FIG. 8 because of an incomplete seal along area 30, it would not matter because the fluid in $B_1$ and $B_2$ is essentially the same. While the fluid flows are generally maintained in their respective passageways, the fact that slight leakage in this area makes no difference, is particularly beneficial to the new design because no sealant is needed in this area. To the extent that sealant is eliminated, similarly the corresponding labor effort and cost is reduced.

FIG. 8 also shows the blocking of portions of various passages in order to establish the Series X cross-flow or counter-flow flow pattern. More specifically by comparing FIGS. 6 and 8, the upper parts A in FIG. 8 of the passages A from FIG. 6 are blocked, while the lower parts B in FIG. 8 of all the passageways B in FIG. 6 are blocked. As is seen in earlier FIG. 4, at the opposite end of each passage A for example, the lower portion of the passagve is blocked, whereas the upper portion is open; this alternate blocking is typical throughout the device as was explained earlier. The manner of creating the blockages will be shown in subsequent figures.

Figure 9:
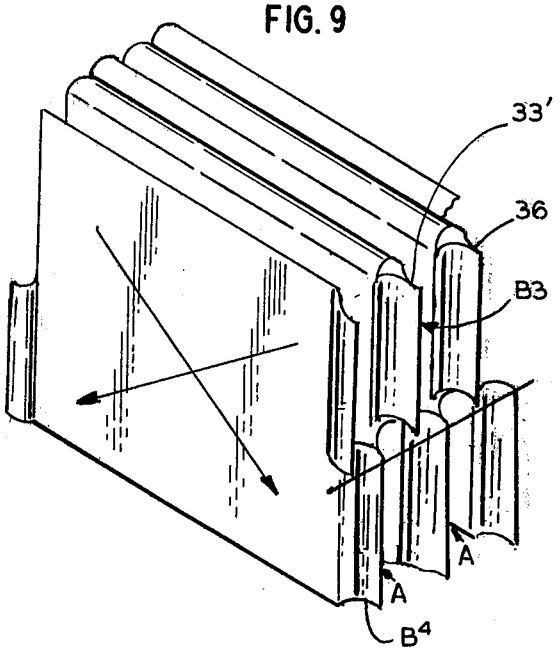
FIG. 9 is a fragmentary perspective view of a core corresponding to FIG. 6, showing the construction stage whereby certain end edges of the passageways are pinched together and thereby closed.

FIG. 9 shows the next step in construction; the pinched portion $A_1$ of FIG. 9 corresponds to the blocked portion $A_1$ in FIG. 8. What has been done is that edges 31' and 32' of blocked area $A_1$ in FIG. 8 have been pinched together into the closed end 33' in FIG. 9. Similarly the edges 34' and 35+ of blocked portion $A_2$ in FIG. 8 have been pinched together to form the closed end 36 in FIG. 9. After such pinching there remains the clear passageway indicated as $B_3$ in FIGS. 8 and 9. Similarly as shown in FIG. 8 there are pinched portions at the bottom namely at $B_4$ and $B_5$ for example which are formed by pinching the edges 37 and 38 of the ends of the folded sheet metal. It should be apparent with this kind of alternate pinching and exposed openings, that the X-shaped flow pattern will result for the Series X heat exchangers.

Figure 25:
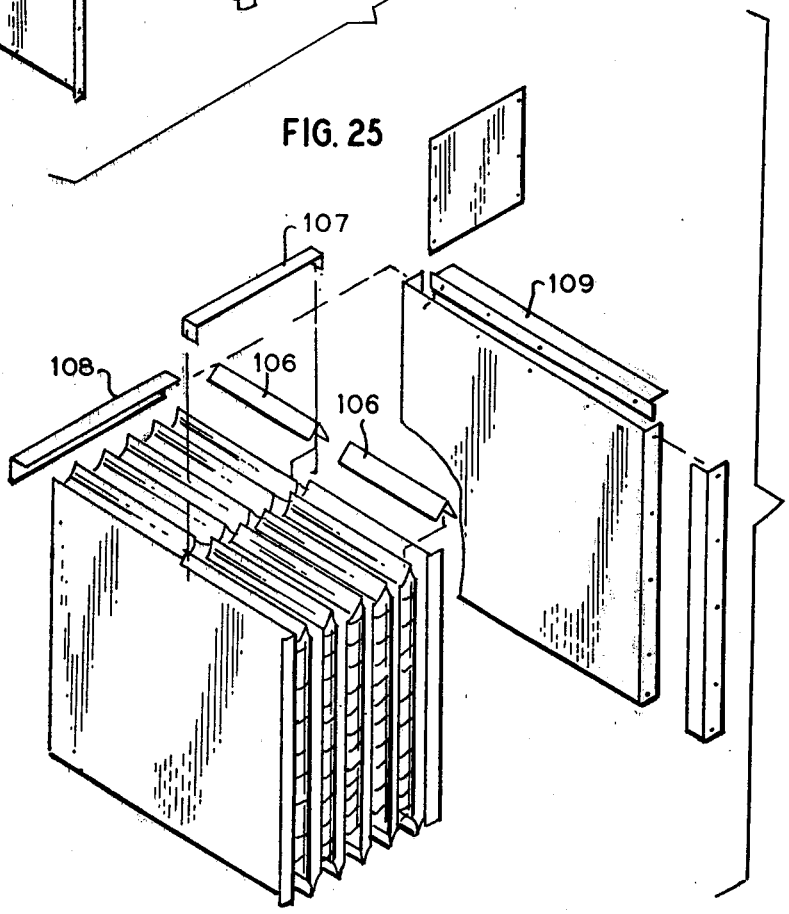
FIG. 25 is an exploded perspective view of a Series-X heat exchanger, that is a variation of FIG. 22.

FIG. 10 shows further details of the embodiment of FIG. 9. At the lower left portion of FIG. 10 there is shown a pinched portion 39 formed by closing edges 40 and 41 of the first passage 42; there is an adjacent pinched part 43 formed by closing the edges 44 and 45 of the second passage 46, while thereby leaving between them the open passage 47. At the bottom, the alternate passages are established by the closure 48, for example, using edges 49 and 50 of the second and third wall portions. In FIGS. 9, 10, 22 and 25, the edges of the partitions are notched or slit to better facilitate the division of passageways, and a T-shaped divider clip 51 (FIG. 10) is installed at the dividing line between the upper passages and lower passages. Preferably, this T-clip is secured at the time the V-clips 52 are crimped about the joined edges of the partitions; if necessary a small amount of sealant is added at areas 53, i.e., the junctures of the pinched portions and the T-shaped clip. In small units where less strength and rigidity are required the notches and T-clip are replaced by a flat strip and sealant as shown in FIG. 25.

FIG. 11 shows a view similar to that in FIGS. 9 and 10; however, the edges 54T at the top and 54B at the bottom are pinched closed along their entire length. Thus, each passageway is open at one end and one side, and closed at the opposite end and side. Consequently, all the hot fluid can enter alternate passages at the top end 55 flow the length of the heat exchanger, and then exit through a discharge area 56 on the front surface. Meanwhile, the cold fluid has entered alternate chambers through the bottom end 57, flows the length of the heat exchanger, and exits through the opposite rear side 58, producing the flow path for the Series H heat exchangers indicated in the symbolic representation of FIG. 11A.

FIG. 12 illustrates the Series K heat exchanger, which is made somewhat similarly to the Series H heat exchanger, in that the end edges 59 are pinched along their full length so that fluid of one temperature enters one end 60, travels the full length of the heat exchanger and out the other end 61; simultaneously, fluid of a different temperature extreme enters the front at one end 62, travels the length of the heat exchanger, and discharges through the front at the other end 63 in the K flow pattern.

Figure 13:
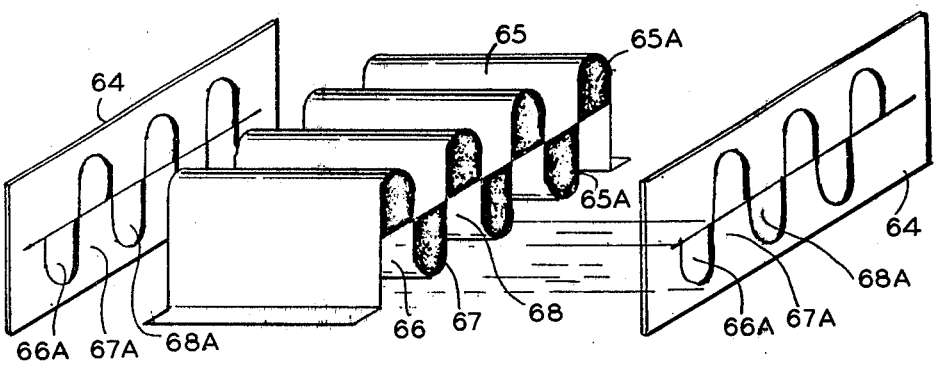
FIG. 13 in a schematic representation, is an exploded perspective view showing another assembly stage of the heat exchanger core, with the front and rear end walls positioned to cooperate with the folded foil for defining the sealed ends of various passages.

Next we will consider the manufacture and assembly of the end plates 64 with the folded foil 65, as schematically represented in FIG. 13. The shaded areas 65A at the ends of certain passages represent areas closed as by pinching the adjacent walls together, as described earlier. Between these closed part are open passages, and the end plates will have corresponding open and closed parts. Thus, passage 66 aligns with aperture 66A of the end plate; pinch 67 aligns with wall 67A of the end plate and will be joined thereto; passage 68 aligns with aperture 68A; etc. A preferred actual end plate is described below.

Figure 14:
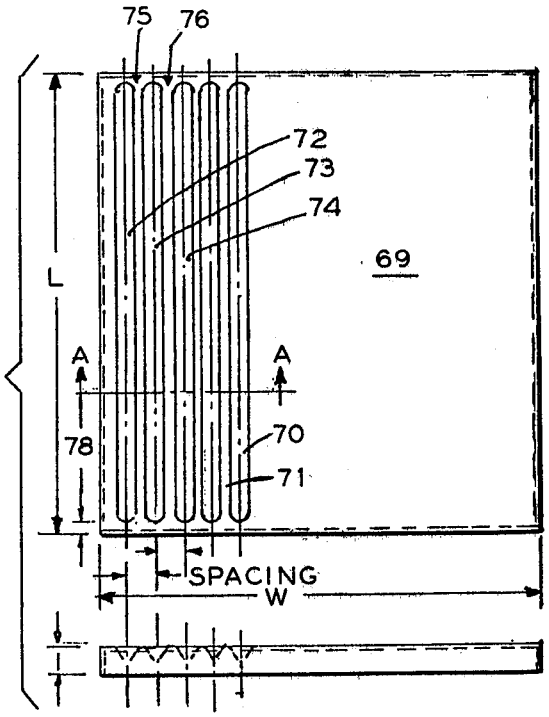
FIG. 14 is a plan view of one end cap (front or rear wall) for the core of the heat exchanger.
Figure 15:
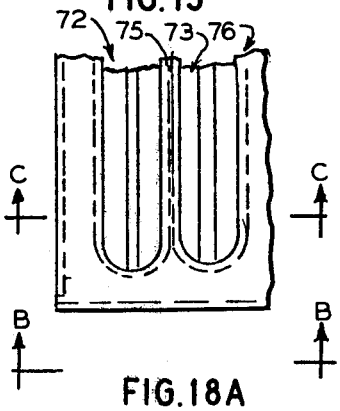
FIG. 15 is a fragmentary detail view of the end cap of FIG. 14.

FIGS. 14–18 illustrate how the end plate is made, and FIGS. 19 and 20 illustrate how this completed end plate is assembled with a folded sheet metal to produce the final joint. FIG. 14 illustrates the plan view of a typical end plate 69 showing a plurality of closely spaced elongated depressions 72, 73, 74, etc. FIG. 15 shows a fragmentary detailed view of the sheet 69 of FIG. 14. As indicated there are downward depressions or grooces 72, 73 and 74 with strips 75 and 76 for example, between the grooves. The front elevation view of FIG. 16 taken along line B—B of FIG. 15, illustrates that for groove 72 for example, there is a bottom part 77, and the adjacent strip 75 has downward extending legs 78 and 79. FIG. 17 shows a sectional view taken along line C—C of FIG. 15, thereby illustrating more clearly the groove portions 77 and strip portions 75 with downward extending leg portions 78 and 79.

Figure 18A:
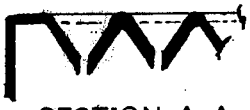

As shown in FIG. 18 the end plate 69 has been die-punched and the bottom portions 77 of each depression or groove have been pierced, severed or otherwise removed. What remains are a plurality of concave ribs such as 75 with downward extending legs 78 and 79 and passageways 80 between each two ribs.

In the next stage of assembly after the appropriate end edges of the folded sheet metal have been pinched together as indicated at 81 and 82 for example in FIG. 19, the end plate 69 is moved into position such that a pair of downward extending legs 78 and 79 of a rib 75 overlie the pinched portion 81, and similar concave ribs overlie corresponding pinched portions as indicated. FIG. 20 illustrates how the legs 78 and 79 are compressed or pinched about the pinched portion 81 forming a permanently joined and sealed unit. With this construction, the result is a wide opening 80 between each two pinched edges which readily admit the flow of fluid into adjacent chambers marked B in FIG. 20. At the opposite end the alternate walls indicated as 83 and 84 are pinched together with a corresponding concave rib section 85 as symbolically indicated in FIG. 20.

Since a typical end plate 69 is essentially a single sheet which is die-punched and then cut to provide the exposed edges of the concave ribs, the entire flow pattern can be established by placing such an end plate into proximity of the end edges of the folded core portion. Then by appropriate pinching of selected portions of the end edges of the accordian folded core and assembly thereto of the end plate, the flow paths are established.

As indicated earlier in a separate assembly step represented by FIG. 8, the top and bottom walls are secured to close the open fourth side of each passageway; FIG. 21 illustrates further assembly of a preferred embodiment. More particularly for strength and further attachment to other components of a broader system, the side walls are strengthened by a frame portion 86 which fits within the flanged end 87 of the outer partition wall 88. At the junction of flange 87 and frame 86 an angle plate 89 is added for helping to seal the space and further strengthen the assembly.

As indicated earlier the basic heat exchanger structure may be used for a variety of different counter-flow configurations by simply varying the latter stages of construction, and thereby altering the fluid flow paths to produce the Series X, H, K or other designs. Accordingly, the heat exchanger core of FIG. 21 may be formed into a K-series system, for example, by the following construction. A rear plate 90 is added to cover and seal the middle area of the passages 91 whose open sides face rearward; at the top and bottom respectively, of plate 90 are inlets 92 and outlets 93 for communicating with passages 91; a front plate 94 is added to cover and seal the full length of the passages 95 whose open sides face forward. The top end edges 96 of passages 91 are closed and sealed by either individual seal strips 97 or by end plate 98 with its integral seal strips 99. Between the seal strips are spaces or apertures 100 for communication with passages 95. Bottom plate 101 is similar to top plate 98.

Figure 22:
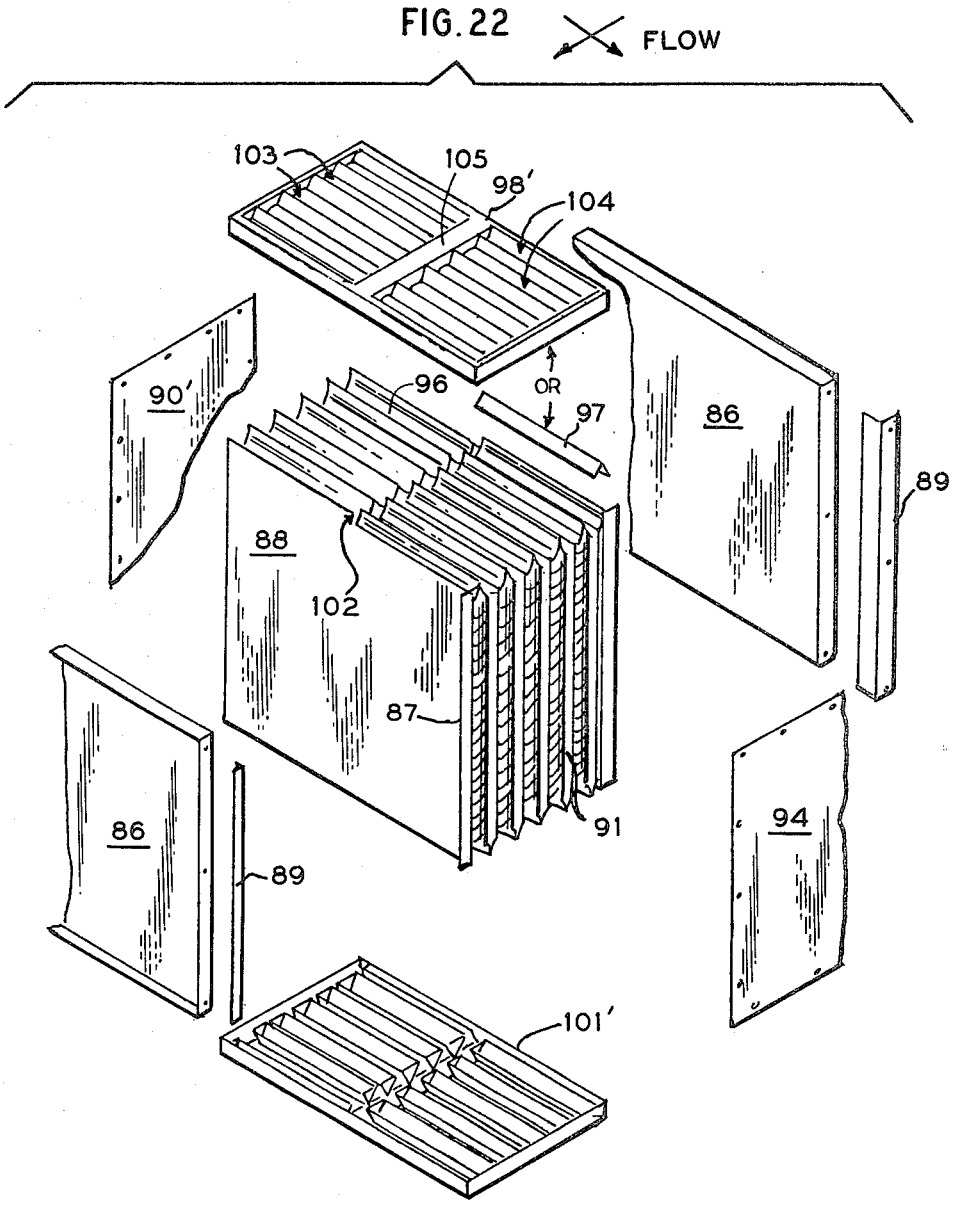
FIG. 22 is similar to FIG. 21 for a Series X heat exchanger.

FIG. 22 illustrates the assembly of a Series X counter-flow heat exchanger, which is generally similar to assembly in FIG. 21 of a Series K heat exchanger. The basic core part is a single strip of metal folded to define the parallel passages; however, in this version the end edges of the partition walls have slits or notches 102 to aid in separating the hot ducts 103 from the cold ducts 104. Again there is the choice of individual seal strips 97 or an end plates 98', except that this end plate has a divider strip 105 which becomes positioned in the notches 102 and is sealed therewith; bottom end plate 101' is similar. To complete assembly of this Series X apparatus front plate 94, rear plate 90', and side plates or frame 86 are added and secured.

Figure 24:
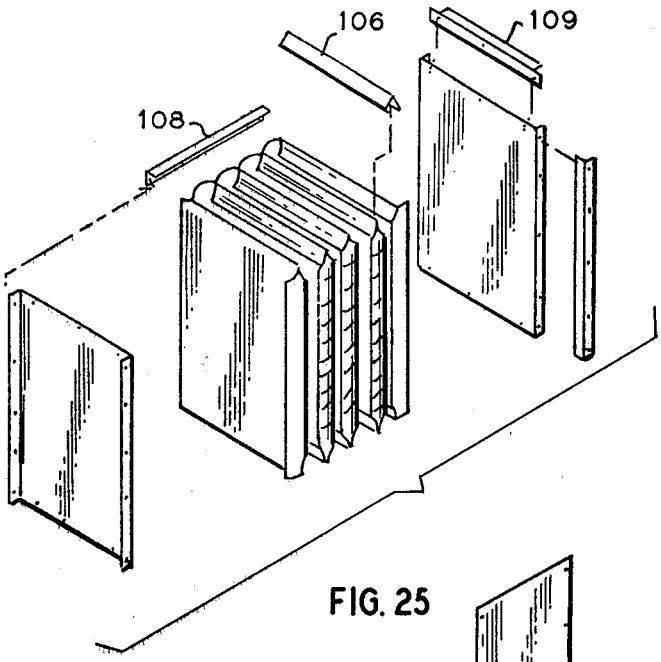
FIG. 24 is an exploded perspective view of a Series-K heat exchanger, that is a variation of FIG. 21.

FIGS. 24 and 25 illustrate assembly techniques similar to FIGS. 21 and 22, but using individual seal strips 106 instead of end plates, adding divider strips 107, and finally adding strips 108 and 109 to form a supporting frame about the partitions. These frames should be adequate for smaller apparatus or those subject to lesser stress loads. When using the divider strips 107, either float or T-shape, which traverse and engage the notched areas of the partitions, it is possible to use very little sealant, since the foil partitions are quite maleable and can be easily bent and crimped to seal the fluid passage.

Figure 23A:
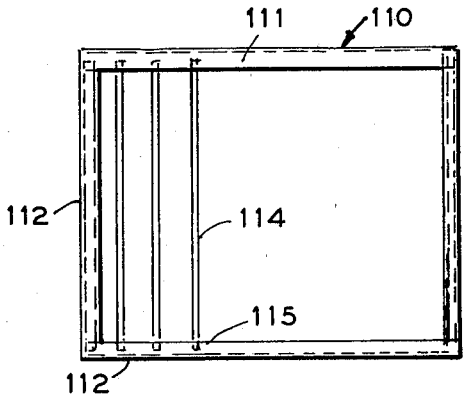
FIG. 23A is a plan view of an end cap, with the grooves formed by welding.
Figure 23D:
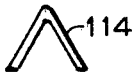
FIG. 23D is a detail sectional view of a rib in FIG. 23B and 23C.
Figure 23B:
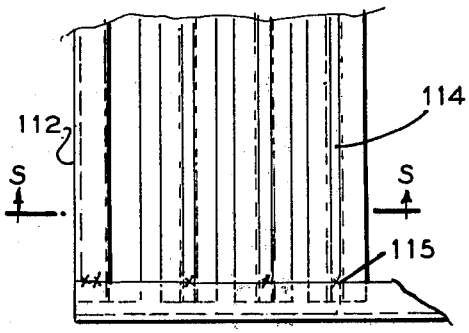
FIG. 23B is a detail of one corner of FIG. 23A.
Figure 23E:
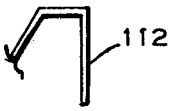
FIG. 23E is a detail sectional view of the frame of FIGS. 23B and 23C.
Figure 23C:
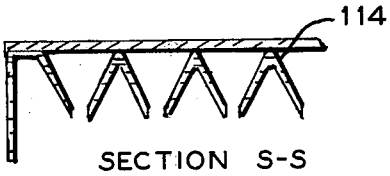
FIG. 23C is a sectional view taken along line S—S of FIG. 23B.

FIG. 23A illustrates a different version of the end plate 110 which is formed by weld construction instead of a single piece of sheet metal die-punched into shape. Accordingly, a rectangular frame 111 is formed of four beams 112 and 113 welded or brazed together as in FIG. 23B. Next the V-shaped ribs 114 are positioned and welded or brazed at their ends 115 as indicated, to provide a die-punched sheet structure of FIG. 14, without having to carry out the steps: creating an appropriate die, die-punching the flat sheet in its origional form, and then severing the bottoms of the depressions to provide the concave or V-shaped ribs. FIGS. 23C, D and E illustrate further details of this frame 110. This welded type end plate has the advantage of reduced cost for initial construction because simple standard form pieces can be used, however, for high volume the welding piece would be more expensive, because of the multiple pieces and considerable labor expense in assembling all these different parts together.

It should be understood that a significant accomplishment of the present invention is the provision of heat exchangers that are at least as thermally efficient as others, but are significantly simpler, lighter in weight, and less expensive than comparable prior art units. Less sealant is required, and where the die-punched single-piece end plate is used, the welding of a plurality of parts is avoided. In fact, with the crimping technique, all welding steps may be avoided. Also, these new devices are quite small and compact, and are readily adaptable for use in more comprehensive systems. A still further advantage in regard to both economics and convenience, is the ease of cleaning, inspecting and repairing these new heat exchangers by merely removing the panels which cover the open sides of the fluid passages. With such removal one can easily see and have access well into the passageways. By utilizing a single strip with successive reverse bands to form the passages, cross-contamination is essentially eliminated, since the majority of prior art junctions of separate partitions are no longer employed. The features described above and others simplify and reduce the cost of manufacture dramatically, to an extent hardly expected in this otherwise extensively developed field. Thus, the new structural features and/or manufacturing techniques disclosed and claimed herein, have provided significant and valuable progress in the heat exchanger art.

The embodiments illustrated and described above for heat exchangers, methods of making same, and the foil for these devices are merely representative of broader concepts which are the subjects of this application and are presented in the claims. Accordingly, various modifications of these disclosures are possible within the spirit and intent of this invention and appended claims.

What is claimed is:

1. In a heat exchanger including a housing and a core part having a plurality of generally parallel partitions defining between them fluid fow passages which are alternately spaced as even-numbered and odd-numbered passages respectively for relatively hot and cold fluids to flow in counter-flow heat exchanger relationship, the improvement wherein said core part comprises:

(a) a continuous metal strip folded in successive reverse bends thereby defining said partitions and intermediate strips between and connecting said partitions, whereby each two adjacent partitions and intermediate strip define walls of one of said passages with a remaining open side and opposite edge ends, (b) first side closure means for closing a portion of said open sides on said one side of said core, (c) second side closure means for closing a portion of the open sides on said other side of said core, (d) first edge end closure means for closing adjacent edge ends of partitions on one end of said core for establishing between said closed adjacent edge ends openings to said passages, (e) second edge end closure means for closing adjacent edge ends of partitions on the opposite end of said core for establishing between said closed adjacent edge ends openings to said passages, (f) whereby said first and second side closure means together with said first and second edge end closure means establish said passages into a counter-flow system of said even-numbered and odd-numbered passages, and (g) partition spacing means for spacing adjacent partitions which define the walls of a passage to permit angular fluid flow comprising a plurality of separated projections which project from a partition surface toward the adjacent partition which forms the passage, said projections being arranged in a pattern providing for angular fluid flow between projections so that fluid flows angularly throughut the entire passage.

2. Apparatus according to claim 1, wherein each end of said passages is defined by edges of said adjacent partitions extending in the same direction, and each of said first and second edge end closure means comprises a sealing junction of said edges for the part of each end that is closed.

3. Apparatus according to claim 2, wherein each of said sealing junctions has opposite sides generally parallel to said partition, and each of said first and second edge end closure means for a typical junction comprises a seal strip of deformable material overlying and folded and crimped about both sides of said junction.

4. Apparatus according to claim 3, wherein said seal strip is generally V-shaped in cross-section before being crimped onto one of said junctions.

5. Apparatus according to claim 3, wherein each of said first and second edge end closure means is an end plate comprising a frame and a plurality of said seal strips traversing said frame and spaced apart distances corresponding to the spacing of said passages whose ends are to be closed.

6. Apparatus according to claim 5, wherein said seal strips are separate components having ends which are secured to said frame.

7. Apparatus according to claim 5, wherein said end plate comprises a single piece of sheet metal die-punched and cut to define a plurality of said strips with a slot defined between each two adjacent strips as an aperture for fluid flow into or out of one of said passages.

8. Apparatus according to claim 1, described with said passages oriented to extend generally from left to right, the improvement wherein each end of a passage has upper and lower portions, said first edge end closure means closes the right end upper portions and said second edge end closure means closes the left end lower portions of the even-numbered passages, and said first edge end closure means also closes the right end lower portions and said second edge end closure means also closes the left end upper portions of the odd-numbered passages, thereby providing an "X-Series" counter-flow system, whereby hot fluid may flow from the upper left to the lower right of the even passages and cold fluid may flow from upper right to lower left of the odd passages.

9. Apparatus according to claim 1, described with said passages oriented to extend generally from top to bottom, and said open sides of the passages facing forward and rearward and having upper and lower portions adjacent said top and bottom ends respectively, the improvement wherein, for said even-numbered passages, said third closure means closes the top ends thereof and said first closure means closes the lower portions of the front sides of these passages, and for said odd-numbered passages, said fourth closure means closes the bottom ends thereof and said second closure means closes the upper portions of the rear sides of these passages, thereby providing an "H-Series" counter-flow system, whereby hot fluid may flow into the bottom of the even-numbered passages and out of the front upper portions thereof, and cold fluid may flow into the top of the odd-numbered passages and out of the rear lower portions thereof.

10. Apparatus according to claim 1, described with said passages oriented to extend generally from top to bottom, and said open sides of the even-numbered passages facing rearward and of the odd-numbered passages facing forward, with upper and lower portions of said open front side adjacent said top and bottom ends respectively, the improvement wherein, for said even-numbered passages, openings are maintained in the top and bottom ends thereof and said first closure means closes the rear open sides, and for said odd-numbered passages, said third and fourth closure means close both ends thereof and said second closure means closes the front sides intermediate said upper and lower portions thereof, thereby providing a "K-Series" counter-flow system, whereby hot fluid may flow into the bottom and out the top of the even-numbered passages, and cold fluid may flow into the upper portion of the front side and out of the lower portion of the front side of the odd-numbered passages.

11. A heat exchanger according to claim 1 wherein said continuous metal strip comprises sheet metal which is bendable to form the partitions which define between them fluid flow passages, said strip being die-punched to define in the surface thereof adjacent partitions separated by bend lines extending transversly of the length of the strip, and to further define in each partition a pattern of depressions extending donward and projections extending upward in the surface theroef, said depressions and projections comprising spacers of said partition spacing means for adjacent passages, and to still further define in each partition stiffening ribs, said stiffening ribs comprising first elongated stiffening ribs extending generally parallel to and adjacent said bend lines and second elongated stiffening ribs extending diagonally relative to said bend lines, said second elongated stiffening ribs defining Xs with said first elongated stiffening ribs and said spacers being situated between the arms of the Xs, said patterns of ribs and spacers in one partition being essentially the same as the pattern in the adjacent partition, except that where ribs extend upward in one partition the corresponding ribs in the adjacent partition extend downward, and where a spacer extends upward in one partition the corresponding spacer in the adjacent partition extends upward also, and similarly corresponding spacers extend downward in adjacent partitions, whereby for typical adjacent partitions folded with their up sides facing each other, corresponding upward extending spacers will extend toward each other for keeping the partitions apart, and corresponding stiffening ribs will have essentially the same spacing between them as the space between the partitions so as not to restrict fluid flow between said partitions.

12. In a heat exchanger according to claim 1, the improvement wherein said core part is formed into one of said "X-, H- and K-Series" counter-flow heat exchange system configurations according to the parts of said open sides and edge ends of the passages which are closed.

13. A heat exchanger according to claim 1 wherein said continuous metal strip comprises sheet metal which is bendable to form the partitions which define between them fluid flow passages, said strip being die-punched to define in the surface thereof adjacent partitions separated by bend lines extending transversely of the length of the strip, and to further define in each partition a pattern of depressions extending downward and projections extending upward in the surface thereof, said depressions and projections comprising spacers of said partition spacing means for adjacent passages, and to still further define in each partition stiffening ribs, said patten of ribs and spacers in one partition being essentially the same as the pattern in the adjacent partition, except that where ribs extend upward in one partiton the corresponding ribs in the adjacent partition extend downward, and where a spacer extends upward in one partition the corresponding spacer in the adjacent partition extends upward also, and similarly corresponding spacers extend downward in adjacent partitions, whereby for typical adjacent partitions folded with their up sides facing each other, corresponding upward extending spacers will extend toward each other for keeping the partitions apart, and corresponding ribs will have essentially the same spacing between them as the space between the partitions so as not to restrict fluid flow between said partitions.

* * * * *